US009044764B2

(12) United States Patent
Jochheim et al.

(10) Patent No.: US 9,044,764 B2
(45) Date of Patent: Jun. 2, 2015

(54) DEVICE FOR APPLYING VISCOUS MEDIA

(75) Inventors: Markus Jochheim, Ratingen (DE); Martin Kotecki, Oberhausen (DE); Dieter Baldauf, Berlin (DE); Achim Skicki, Haan (DE)

(73) Assignee: BAUMER HHS GMBH, Krefeld (DE)

( * ) Notice: Subject to any disclaimer, the term of this patent is extended or adjusted under 35 U.S.C. 154(b) by 58 days.

(21) Appl. No.: 13/990,799

(22) PCT Filed: Nov. 28, 2011

(86) PCT No.: PCT/EP2011/071169
§ 371 (c)(1),
(2), (4) Date: Jun. 21, 2013

(87) PCT Pub. No.: WO2012/072576
PCT Pub. Date: Jun. 7, 2012

(65) Prior Publication Data

US 2013/0269605 A1 Oct. 17, 2013

(30) Foreign Application Priority Data

Dec. 3, 2010 (DE) ..... 20 2010 013 054 U

(51) Int. Cl.

| | |
|---|---|
| ***B05C 3/02*** | (2006.01) |
| ***B05C 5/00*** | (2006.01) |
| ***B05B 1/14*** | (2006.01) |
| ***B05C 5/02*** | (2006.01) |

(52) U.S. Cl.
CPC ..... *B05B 1/14* (2013.01); *B05C 5/0258* (2013.01); *B05C 5/0279* (2013.01)

(58) Field of Classification Search
CPC ..... B05C 5/0254
USPC ..... 118/300, 313–315, 325, 410, 419, 420, 118/411, 407; 239/601, 597, 553.5; 156/578
See application file for complete search history.

(56) References Cited

U.S. PATENT DOCUMENTS

| | | | | |
|---|---|---|---|---|
| 2,921,748 | A * | 1/1960 | Kane | 239/533.13 |
| 4,535,719 | A | 8/1985 | Regan | |
| 4,644,622 | A * | 2/1987 | Bauer et al. | 28/271 |
| 5,667,124 | A * | 9/1997 | Bannenberg | 242/615.11 |

(Continued)

FOREIGN PATENT DOCUMENTS

| | | |
|---|---|---|
| DE | 35 06 393 A1 | 8/1986 |
| DE | 297 08 102 U1 | 7/1997 |

(Continued)

*Primary Examiner* — Yewebdar Tadesse
(74) *Attorney, Agent, or Firm* — Norman B. Thot

(57) ABSTRACT

A device for applying a fluid media onto a substrate as the substrate is moved past the device in an advancement direction includes a channel. A slot nozzle is arranged downstream of the channel in a flow direction of the fluid media. A nozzle body comprises dispensing nozzles. Each dispensing nozzle comprises a dispensing opening which leads into the channel. The dispensing openings are arranged on a line extending transverse to the advancement direction. Application modules are configured to intermittently dispense the fluid media onto the substrate via the dispensing nozzles. The application modules are arranged on the nozzle body in at least two rows offset from each other transverse to the advancement direction of the substrate. Adjacent rows of the at least two rows are inclined towards one another at an inclination angle. The at least two rows are arranged to incline along the line.

5 Claims, 2 Drawing Sheets

(56) References Cited

U.S. PATENT DOCUMENTS

| | | | |
|---|---|---|---|
| 5,769,947 | A | 6/1998 | Krappweis |
| 2005/0015050 | A1 | 1/2005 | Mowery et al. |
| 2005/0045095 | A1 | 3/2005 | Pahl |
| 2006/0046917 | A1 | 3/2006 | Duwendag et al. |
| 2008/0011227 | A1 | 1/2008 | Arnaboldi |

FOREIGN PATENT DOCUMENTS

| | | | |
|---|---|---|---|
| DE | 102 42 732 | A1 | 3/2004 |
| DE | 103 20 813 | A1 | 12/2004 |
| EP | 1 101 537 | A1 | 5/2001 |
| EP | 1 880 773 | A1 | 1/2008 |

* cited by examiner

DEVICE FOR APPLYING VISCOUS MEDIA

CROSS REFERENCE TO PRIOR APPLICATIONS

This application is a U.S. National Phase application under 35 U.S.C. §371 of International Application No. PCT/EP2011/071169, filed on Nov. 28, 2011 and which claims benefit to German Patent Application No. 20 2010 013 054.9, filed on Dec. 3, 2010. The International Application was published in German on Jun. 7, 2012 as WO 2012/072576 A1 under PCT Article 21(2).

FIELD

The present invention relates to a device for applying viscous media, in particular, adhesives, onto a substrate that is movable in an advancement direction, the device comprising a nozzle body that comprises a plurality of dispensing nozzles having dispensing openings, and further comprising a plurality of application modules by means of which fluid media can be intermittently dispensed onto the substrate via the dispensing nozzles and which are arranged on the nozzle body.

BACKGROUND

Such a device is described, for example, in DE 103 29 813 B4, where the application modules are arranged closely side by side in a single row extending transverse to the advancement direction, i.e., are arranged adjoining with the sides facing one another. Each application module communicates with a dispensing nozzle provided in the nozzle body.

In order for the viscous medium to be appliable as needed onto the substrate moving past the device over the full surface without spaces between the lines dispensed by the individual dispensing nozzles, the dispensing openings must have a width that corresponds at least to the width of the application module. The minimum application width is thus limited by the overall width of the application valve. If the width of the dispensing opening is smaller than the overall width of the application modules, the possibilities for obtaining different application patterns on the substrate is also limited by the application window defined by the dispensing openings.

SUMMARY

An aspect of the present invention is to provide an improved device for applying viscous media, in particular, adhesives, by means of which higher flexibility with regard to the form of the application patterns and smaller minimal application widths can be implemented.

In an embodiment, the present invention provides a device for applying a fluid media onto a substrate as the substrate is moved past the device in an advancement direction includes a channel. A slot nozzle is arranged downstream of the channel in a flow direction of the fluid media. A nozzle body comprises a plurality of dispensing nozzles. Each of the plurality of dispensing nozzles comprises a dispensing opening which leads into the channel. The dispensing openings are arranged substantially on a line which extends transverse to the advancement direction. A plurality of application modules are configured to intermittently dispense the fluid media onto the substrate via the plurality of dispensing nozzles. The plurality of application modules are arranged on the nozzle body in at least two rows which are offset from each other transverse to the advancement direction of the substrate. Adjacent rows of the at least two rows are inclined towards one another in a V-shaped manner at an inclination angle. The at least two rows are arranged so as to substantially incline along the line.

BRIEF DESCRIPTION OF THE DRAWINGS

The present invention is described in greater detail below on the basis of embodiments and of the drawings in which.

DETAILED DESCRIPTION

Figure 1:
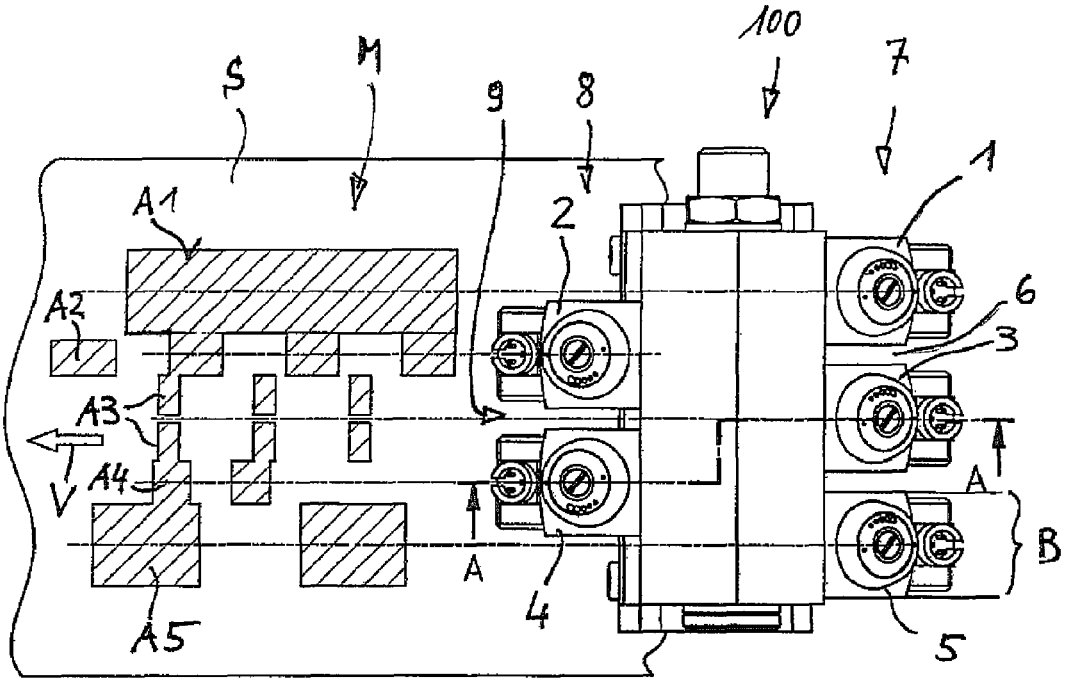
FIG. 1 shows a top view of an embodiment with the substrate transported past the device.
Figure 2:
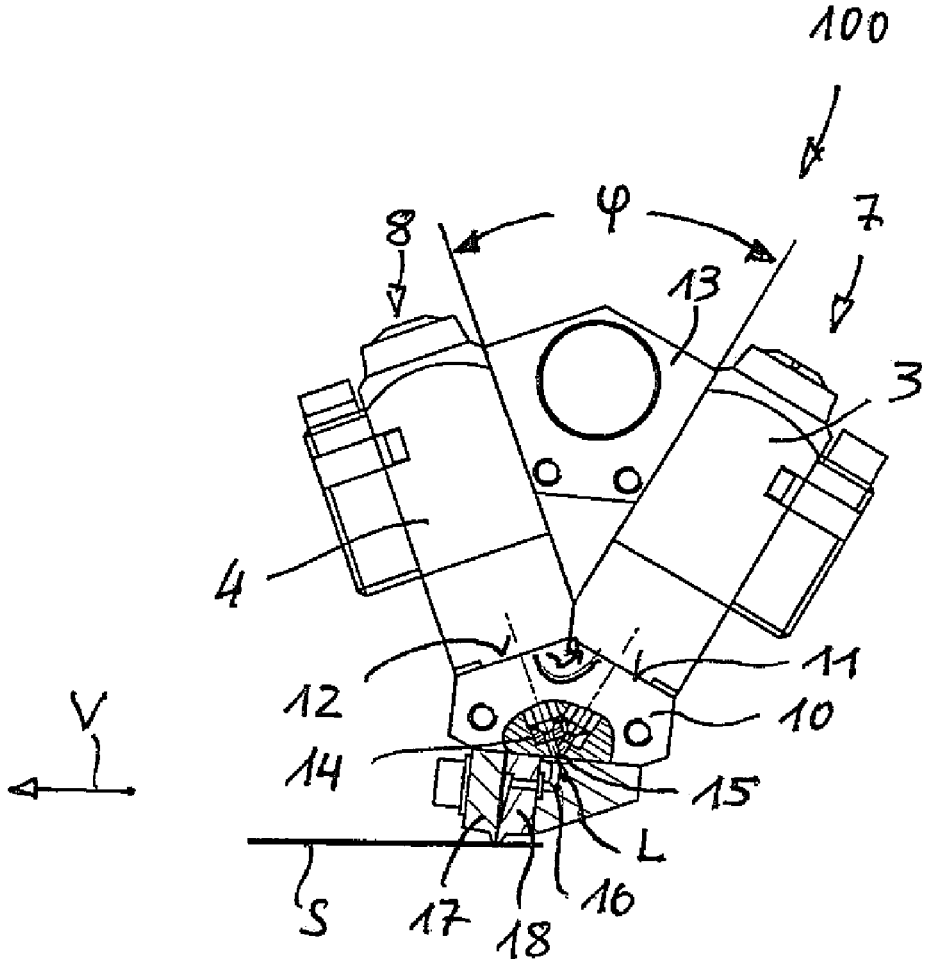
FIG. 2 shows section A-A in FIG. 1.

In the device according to the present invention, the application modules are arranged in at least two rows that are offset from one another transverse to the advancement direction of the substrate. The widths of the dispensing openings of the dispensing nozzles of the one row of the application modules can thus be formed narrower than the width of the associated application module so that, by dispensing viscous media only via this row of the application modules onto the substrate, a strip-shaped application results. The dispensing openings of the dispensing nozzles of the application modules of the at least second row, which application modules are arranged offset transverse to the advancement direction of the substrate with respect to the application modules of the first row, are dimensioned for obtaining an areawide application in the width direction in such a manner that the lines of viscous media dispensed via this row completely fill the spaces between the lines of the first row. A mounting gap can also be left between two adjacent application modules of a row, whereby interchangeability of individual application modules is facilitated.

If exactly two rows of application modules are provided that are offset to one another transverse to the advancement direction of the substrate, these rows can, for example, be arranged offset to one another by half the overall width of an application module. The minimum width of the dispensing opening can then be reduced to half the overall width, i.e., by half with respect to the prior art. If three rows are provided, the lateral offset to the application modules of the respective adjoining row and the width of the dispensing opening will, for example, be a third of the overall width of an application module, a fourth in the case of four rows, etc.

It is principally possible to arrange the rows of application modules including the associated dispensing nozzles one behind the other in the advancement direction of the substrate so that, with regard to the advancement direction, first the fluid media dispensed via the dispensing openings of the first row impinge on the substrate and then the media dispensed via the second dispensing openings, etc.

However, in order to also provide an areawide application of the viscous media onto the substrate as uniformly as possible transverse to the advancement direction thereof, it is desirable to apply the lines dispensed by the different rows of the application modules on the same position with regard to the advancement direction of the substrate. In an embodiment of the device according the present invention, adjacent rows of application volumes are therefore arranged in a V-shaped manner inclined to one another at an inclination angle. It is hereby possible to arrange the dispensing openings of all application modules on a line running transverse to the advancement direction.

The inclination angle between the adjacent rows is selected depending on the overall size of the application module and is usually as small as possible. In an embodiment of the present invention, said angle ranges between approximately 30° and 90°.

In order to once again improve the uniformity of application transverse to the advancement direction of the substrate, the dispensing openings in an embodiment of the device according to the present invention lead into a channel, downstream of which in the flow direction of the viscous media, a slot nozzle is arranged. Such slot nozzles, which are described, for example, in DE 103 20 813, smoothen the lines of viscous media dispensed via the individual dispensing openings and provide that the margins of adjacent lines merge into one another.

In order to be able to adjust the device according to the present invention in a simpler manner for different application conditions, the slot nozzle can, for example, be arranged on a slot nozzle body that is removably flanged onto the nozzle body. A slot nozzle having a smaller slot width can be used if, for example, applying fluid media in thinner layers is desired.

The figures schematically illustrate an embodiment of a device according to the present invention.

An embodiment of a device according to the present invention, as a whole designated by 100, comprises five application modules 1, 2, 3, 4, 5 of which the application modules 1, 3, 5 are arranged closely side by side, except for mounting gaps 6, in a first row 7. The application modules 2, 4 are arranged in a second row 8, again closely side by side except for a mounting gap 9, but are offset transverse to the advancement direction V of a substrate S moved past the device by approximately half the width B of an application module. The application modules can be designed in any manner described in the prior art for intermittently dispensing viscous fluids. They are attached on a nozzle body 10 that extends transverse to the advancement direction V of the substrate S. For this, the nozzle body 10 has a first mounting surface 11 for mounting the application modules 1, 3, 5 of the first row 7, and a second mounting surface 12 for mounting the application modules 2, 4 of the second row 8. The mounting surfaces 11, 12 are inclined to one another at an angle θ of approximately 130° so that the application modules are inclined to one another at an angle ϕ of approximately 50°. For stabilizing the two rows 7, 8 of the application modules, a carrier 13 is provided between the two rows 7, 8.

The nozzle body 10 comprises dispensing nozzles 14, each of which is allocated to an application module 1, 2, 3, 4, 5 so that the medium dispensed by an application module exits through a dispensing opening 15 of the respective dispensing nozzle 14.

All dispensing openings 15 lead on a line L extending transverse to the advancement direction V of the substrate S into a channel 16, downstream of which in the flow direction of the viscous media, a slot nozzle 17 is arranged. The slot nozzle 17 is arranged on a slot nozzle body 18 removably flanged to the nozzle body 10 so that it is easily interchangeable if necessary.

The application modules 1, 2, 3, 4, 5 are designed in a conventional manner. They thus comprise electrically, electromagnetically, pneumatically, hydraulically, piezoelectrically, etc., operated valve arrangements by means of which fluid media fed from the outside, for example, via feed lines that are not illustrated in the drawing, can be intermittently dispensed via the dispensing nozzles 14 through the dispensing openings 15 and can be applied onto the substrate S by means of the slot nozzle 17.

The dispensing openings 15 allocated to the application modules 1, 2, 3, 4, 5 (depending on the application pattern to be applied onto the substrate moving past the device) can have different opening widths transverse to the advancement direction V of the substrate S. If an areawide line application is desired in certain regions, the opening widths only need to be matched with one another.

In FIG. 1, a conceivable application pattern M implementable with a device according to the present invention is illustrated as hatched. For this, the dispensing opening 15 allocated to the application module 1 has a width that results in an application line A1. The application module 2, which in the illustrated application example was intermittently operated for a shorter period than the application module 1, is allocated to a dispensing opening 15 that effects the application line A2. Intermittently dispensing the fluid medium via the application module 3 results in the application line A3. The application module 4 generates the line A4 and, correspondingly, the application module 5 generates A5. This application pattern exemplary illustrated in FIG. 1 shows that by means of the device 100 according to the present invention having two rows 7, 8 of application modules, application lines can be applied onto a substrate moved past the device in lines that are areawide in certain regions and also in lines that have a width smaller than is possible with a conventional device having application modules arranged closely side by side in only one row.

The present invention is not limited to embodiments described herein; reference should be had to the appended claims.

REFERENCE LIST

100 Device
1, 2, 3, 4, 5 Application modules
6 Mounting gaps
7 First row
8 Second row
9 Mounting gap
10 Nozzle body
11 First mounting surface
12 Second mounting surface
13 Carrier
14 Dispensing nozzle
15 Dispensing opening
16 Channel
17 Slot nozzle
18 Slot nozzle body
θ Angle
ϕ Angle
A1, A2, A3, A4, A5 Application pattern
B Width
L Line
M Application pattern
S Substrate
V Advancement

The invention claimed is:

1. A device for applying a fluid media onto a substrate as the substrate is moved past the device in an advancement direction, the device comprising:

a channel;

a slot nozzle arranged downstream of the channel in a flow direction of the fluid media;

a nozzle body comprising a plurality of dispensing nozzles, each of the plurality of dispensing nozzles comprising a dispensing opening which leads into the channel, the dispensing openings being arranged substantially on a line which extends transverse to the advancement direction; and a plurality of application modules configured to intermittently dispense the fluid media onto the substrate via the plurality of dispensing nozzles, the plurality of application modules being arranged on the nozzle body in at least two rows which are offset from each other transverse to the advancement direction of the substrate, wherein adjacent rows of the at least two rows are inclined towards one another in a V-shaped manner at an inclination angle, and the at least two rows are arranged so as to substantially incline along the line.

2. The device as recited in claim 1, wherein the fluid media is an adhesive.

3. The device as recited in claim 1, wherein the inclination angle is from 30° to 90°.

4. The device as recited in claim 1, wherein the slot nozzle is configured so that the fluid media dispensed by adjacent dispensing openings partially merge into one another upon exiting the slot nozzle.

5. The device as recited in claim 1, further comprising a slot nozzle body which is configured to be removably flanged on the nozzle body, the slot nozzle being arranged on the slot nozzle body.

* * * * *